US008033539B2

(12) United States Patent
Takai et al.

(10) Patent No.: US 8,033,539 B2
(45) Date of Patent: Oct. 11, 2011

(54) PRESSDOWN CAM FOR POST PROCESSING DEVICE

(75) Inventors: Shingo Takai, Ibaraki (JP); Yasushi Hashimoto, Ibaraki (JP); Masaru Kawamoto, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 40 days.

(21) Appl. No.: 12/355,066

(22) Filed: Jan. 16, 2009

(65) Prior Publication Data

US 2009/0184454 A1 Jul. 23, 2009

(30) Foreign Application Priority Data

Jan. 18, 2008 (JP) ..... 2008-008577

(51) Int. Cl.
*B65H 37/04* (2006.01)

(52) U.S. Cl. ..... 270/58.11; 270/58.12; 270/58.08; 271/220

(58) Field of Classification Search ..... 270/58.09, 270/58.11, 58.08, 58.12, 58.16, 58.17; 271/220
See application file for complete search history.

(56) References Cited

U.S. PATENT DOCUMENTS

| | | | | |
|---|---|---|---|---|
| 6,142,466 | A * | 11/2000 | Dickhoff | 271/220 |
| 6,332,606 | B1 * | 12/2001 | Seki | 270/59 |
| 6,550,758 | B2 * | 4/2003 | Ardery et al. | 270/58.12 |
| 6,557,842 | B2 * | 5/2003 | Conard-White et al. | 270/58.09 |
| 6,802,501 | B2 * | 10/2004 | Boss et al. | 270/58.07 |
| 7,111,839 | B2 * | 9/2006 | Nishimura | 270/58.23 |
| 7,570,904 | B2 * | 8/2009 | Yaguchi et al. | 399/282 |
| 7,571,904 | B2 * | 8/2009 | Bober | 270/58.12 |

FOREIGN PATENT DOCUMENTS

JP 11-171395 6/1999

* cited by examiner

*Primary Examiner* — Patrick Mackey
(74) *Attorney, Agent, or Firm* — Oblon, Spivak, McClelland, Maier & Neustadt, L.L.P.

(57) ABSTRACT

A sheet post process device with a stapler mechanism includes a conveying path configured to convey a sheet on which an image is formed to the stapler mechanism; a first sensor disposed along the conveying path and configured to detect a moving position of the sheet; and a tray in which the sheets are stacked to undergo a stapling process; and a rotary cam having a spiral shape disposed at a conveying path outlet through which the sheet is ejected from the conveying path to the tray. When the sheet passes through the conveying path outlet, the cam rotates and comes into contact with the sheet to move the sheet to the tray.

8 Claims, 4 Drawing Sheets

PRESSDOWN CAM FOR POST PROCESSING DEVICE

BACKGROUND OF THE INVENTION

1. Field of the Invention

The present invention relates to sheet post process devices of electrophotographic apparatuses, and more particularly to a sheet post process device having a stapler mechanism.

2. Description of the Related Art

As shown in FIG. 5, a sheet post process device having a stapler mechanism includes a conveying path 3 for conveying a sheet on which an image has been formed, a tray 2 for stacking sheets 7 that have been conveyed, and a stapler mechanism 1 for stapling a sheet batch 8 stacked in the tray 2. If the printing speed of the apparatus is high, it is necessary to secure time for the stapling process without reducing the printing speed. Therefore, a branch section denoted by C is provided in the conveying path 3. Plural sheets can be temporarily held in this branch section C to secure time for the stapling process without slowing down the printing process.

Patent Document 1: Japanese Laid-Open Patent Application No. 11-171395 (Japanese Patent No. 3735455).

In recent years and continuing, electrophotographic apparatuses are increasingly being used for printing with higher printing speed. Various types of sheets are used for printing. Accordingly, there are increasing demands for high-performance sheet post process devices capable of processing at high speed and with high reliability.

SUMMARY OF THE INVENTION

The present invention provides a sheet post process device having a stapler mechanism in which one or more of the above-described disadvantages are eliminated.

A preferred embodiment of the present invention provides a sheet post process device having a stapler mechanism suitable for high-speed printing. According to an aspect of the present invention, there is provided a sheet post process device with a stapler mechanism, the sheet post process device including a conveying path configured to convey a sheet on which an image is formed to the stapler mechanism; a first sensor disposed along the conveying path and configured to detect a moving position of the sheet; a tray in which plural of the sheets are stacked to undergo a stapling process; and a cam disposed at a conveying path outlet through which the sheet is ejected from the conveying path to the tray, the cam having a spiral shape and being rotatable, wherein when the sheet passes through the conveying path outlet, the cam rotates and comes into contact with the sheet to move the sheet to the tray.

According to one embodiment of the present invention, a sheet post process device having a stapler mechanism suitable for high-speed printing is provided.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
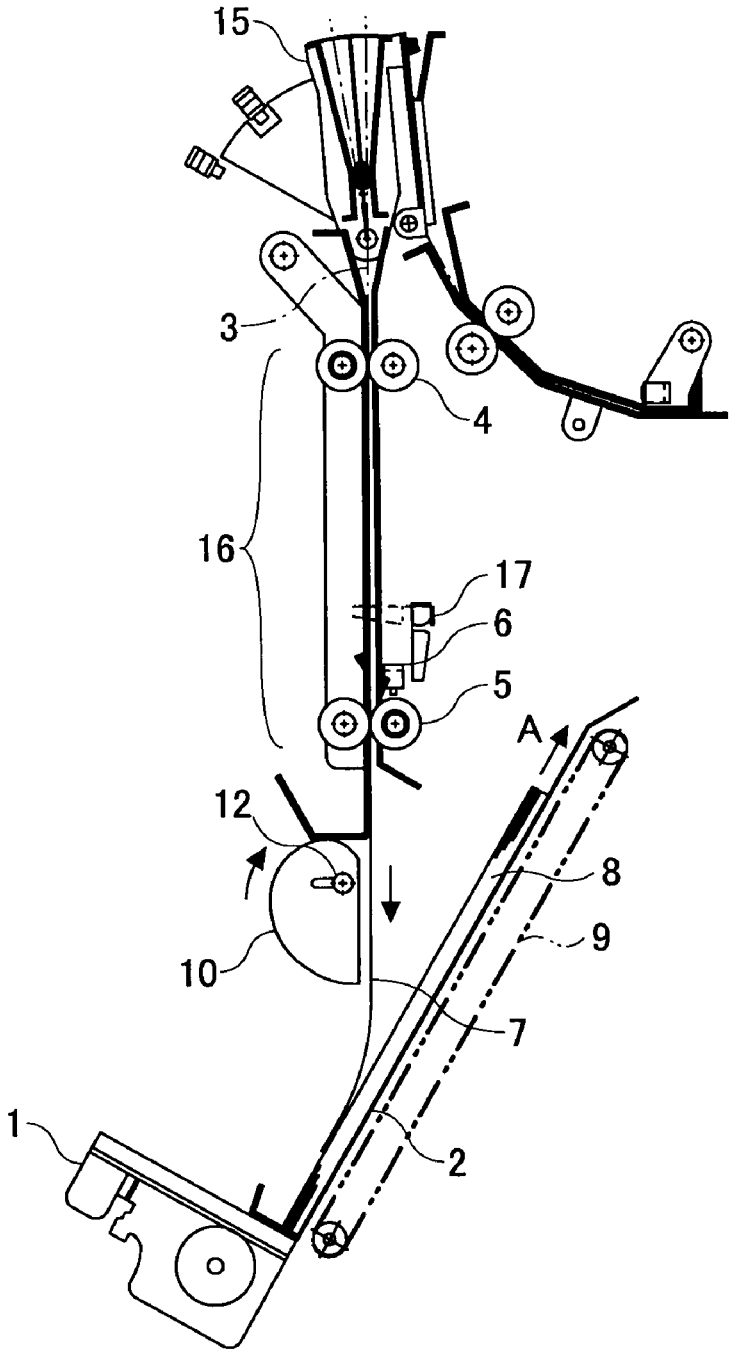
FIG. 1 illustrates a sheet post process device having a stapler mechanism according to an embodiment of the present invention.

In FIG. 1, 1 denotes a stapler mechanism, 2 denotes a tray for stacking sheets to perform the stapling process of the stapler mechanism 1, 3 denotes a conveying path for conveying a sheet on which an image is formed to the tray 2, 4 and 5 denote conveying rollers, and 6 denotes a sensor for detecting the position of the moving sheet 6 (hereinafter, "moving position").

The tray 2 is provided in a tilted manner, and the outlet of the conveying path 3 is provided substantially at the center of and above the tray 2. Accordingly, conveyed sheets 7 are sequentially stacked in the tray 2. When the number of stacked sheets reaches a predetermined value, the stapler mechanism 1 performs a stapling process. Subsequently, a sheet batch 8 which has been stapled is moved in an ejection direction A by a sheet ejecting belt 9.

In a sheet post process device with a stapler mechanism having the above configuration, the outlet of the conveying path 3 is positioned near the center of the tray 2, which is advantageous as the entire apparatus can be made compact. Meanwhile, after the sheet 7 passes through the rollers 5, the sheet 7 is released from restriction, and thus freely falls. However, the time taken for the sheets 7 to be stacked in the tray 2 may vary depending on the thickness or type of the sheets 7, which is disadvantageous for high-speed printing.

Accordingly, in the present embodiment, rotatable cams 10 are provided at the outlet of the conveying path 3. Based on information from the sensor 6, the cams 10 start to rotate as the sheet 7 passes by the side surfaces of the cams 10. The phases of the cams 10 are detected by an actuator 11 and a sensor 14 shown in FIG. 2. The timing of rotating the cams 3 is controlled based on this detected information in combination with the information from the sensor 6 for detecting the moving position. The shape of each cam 10 is an Archimedean spiral shape. That is, assuming the minimum radius along the peripheral surface of the cam 10 is "r", the radius "R" along the peripheral surface of the cam 10 at a position that is away from the minimum radius r by θ degrees is expressed by $R=r+a\theta$ (where "a" is a constant). Furthermore, the other half of the spiral shape has a linear shape. Therefore, by starting to rotate the cams 10 after the leading edge of the sheet 7 has passed through the side surfaces of the cams 10, the cams 10 can smoothly push down the sheet 7 while being in contact with the sheet 7, without damaging the sheet 7.

Figure 2:
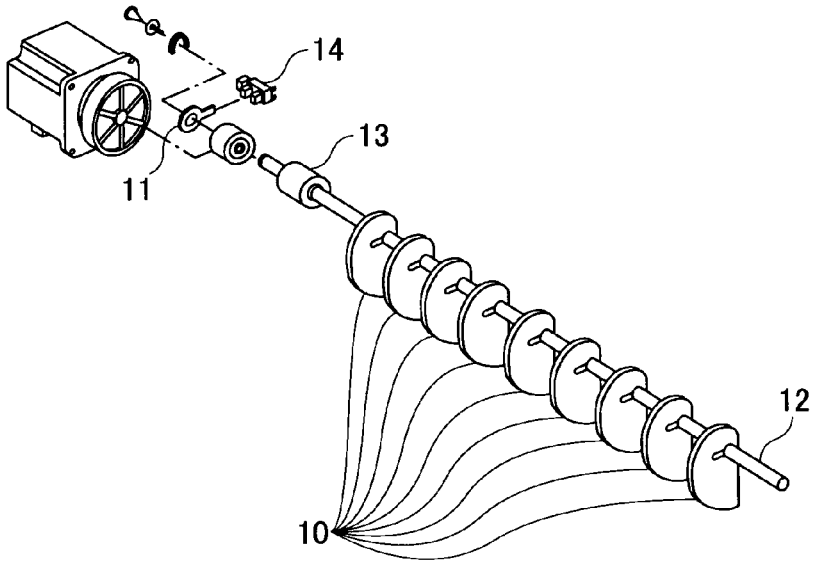
FIG. 2 illustrates the sheet post process device having the stapler mechanism according to an embodiment of the present invention.
Figure 3:
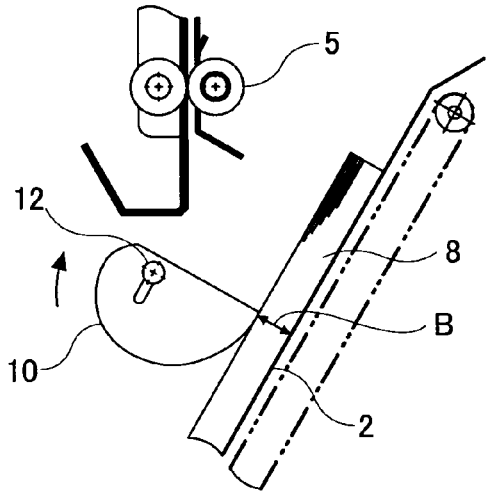
FIG. 3 illustrates the sheet post process device having the stapler mechanism according to an embodiment of the present invention.
Figure 4:
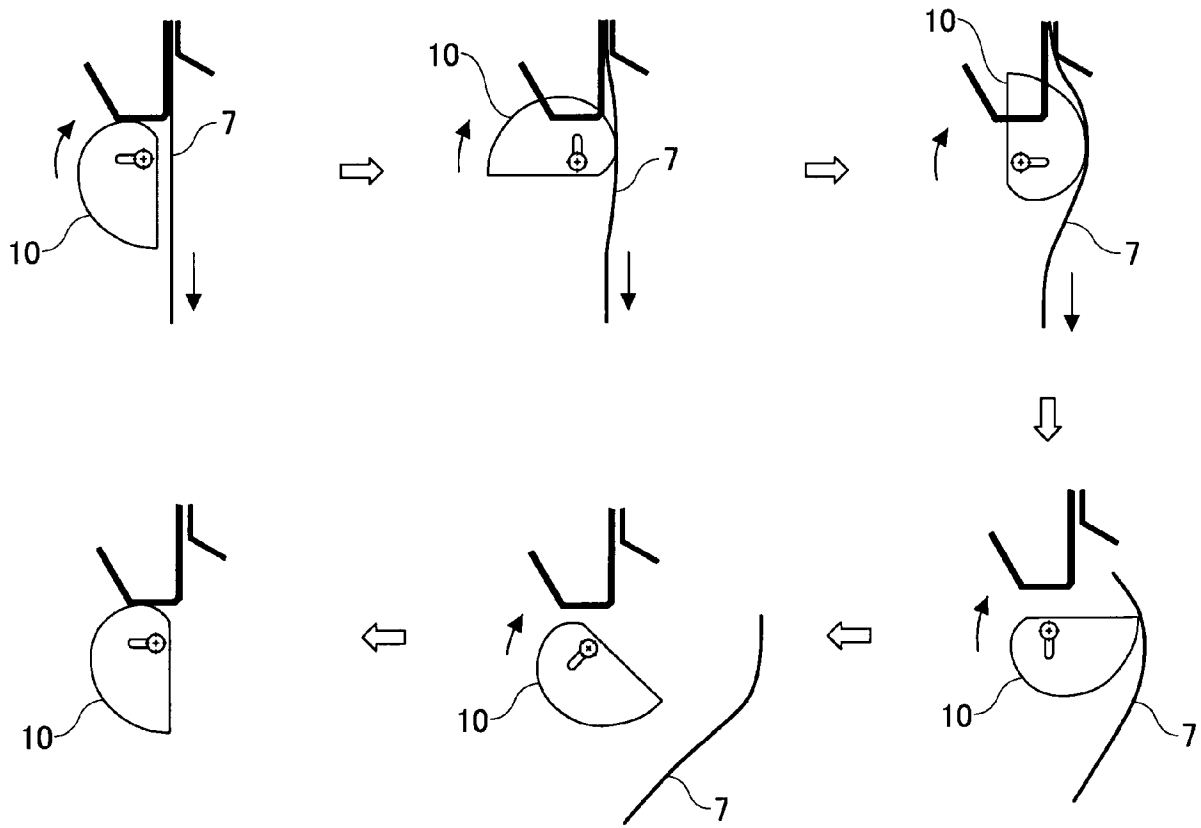
FIG. 4 illustrates an operation of the sheet post process device having the stapler mechanism according to an embodiment of the present invention.

Furthermore, a torque restricting device 13 is connected to a rotary shaft 12 as shown in FIG. 2. The interval B between a maximum radius portion of the cams 10 and the tray 2 is set to be less than the maximum thickness of stacked sheets in the tray 2. Accordingly, even when more than a prescribed number of sheets is stacked in the tray 2 due to a failure of the apparatus, the cams 10 and the sheet batch 8 interfere with each other, and the rotary shaft 12 idly rotates, and therefore no damage is inflicted on the apparatus. That is, the stapler mechanism 1 can have a function of a safety device and a function of detecting whether excessive sheets are stacked.

Furthermore, as shown in FIG. 1, the sheet post process device with the stapler mechanism according to the present embodiment includes a temporary standby conveying path 16 in which the sheets can be temporarily held in order to secure time for the stapling process; a sheet sorting gate 15 for aligning plural sheets in the temporary standby conveying path 16; and a rotary stopper 17 that releases, at appropriate timings, the sheets in a temporary stand by sheet. Due to such mechanisms, it is possible to secure time for stapling sheets according to need, even in an electrophotographic apparatus having high printing speed. Accordingly, the stapling process can be performed without reducing throughput.

In a sheet post process device with the stapler mechanism as described above, even when the sheet conveying path outlet is positioned substantially at the center of and above the tray as shown in FIG. 1, the sheet is forcibly pushed down onto the tray due to the rotation of the cams 10. Therefore, the sheets can be stacked in the tray within a prescribed length of time without being affected by the thickness or the type of the sheet, thereby securing stable sheet processing performance even during high-speed printing.

Figure 5:
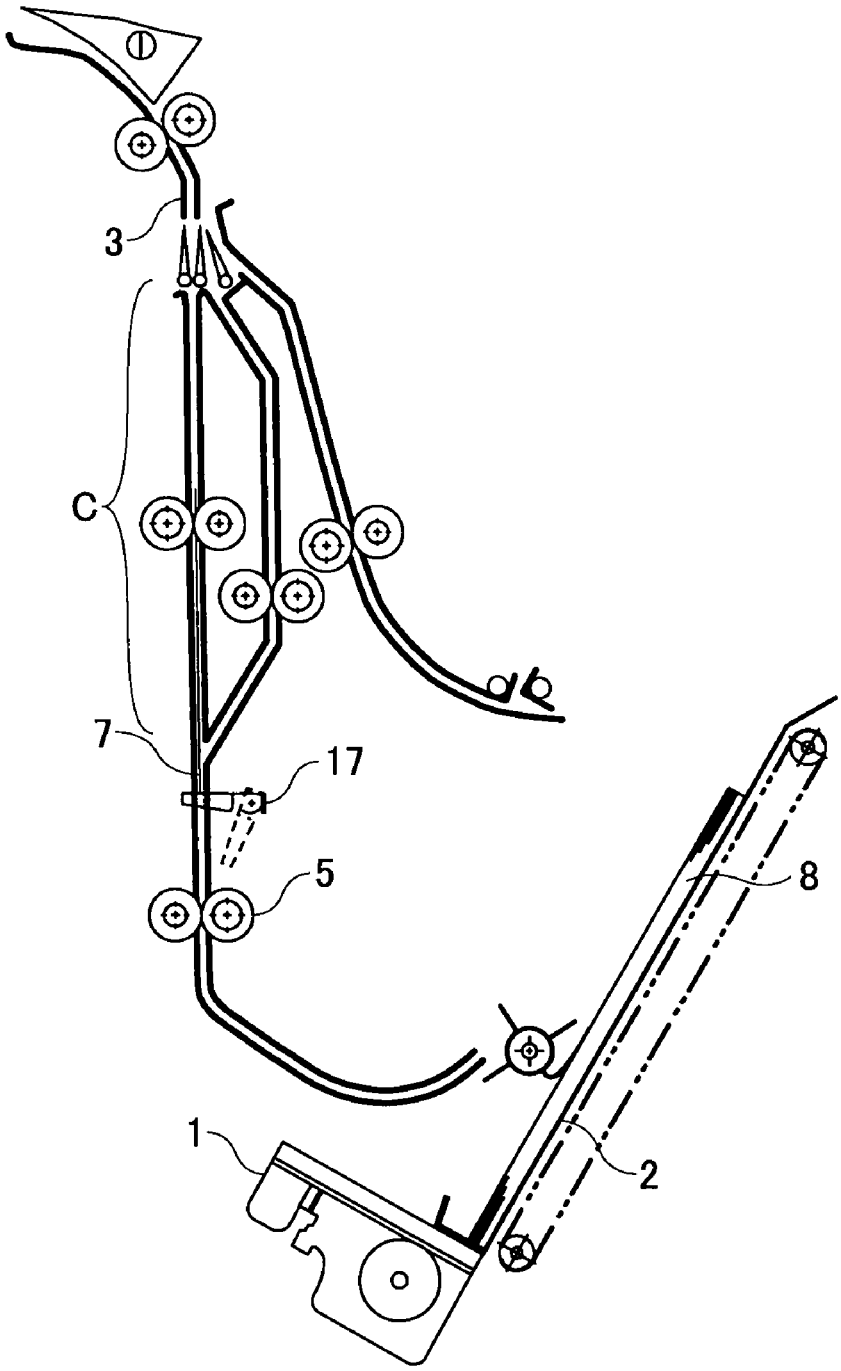
FIG. 5 illustrates a conventional sheet post process device having a stapler mechanism.

Furthermore, by positioning the sheet conveying path outlet and the tray as shown in FIG. 1, the sheet conveying path can be made shorter than that of the conventional technology shown in FIG. 5, and therefore the entire apparatus can be made compact.

Furthermore, the cams have an Archimedean spiral shape, and therefore the cams gradually come in contact with the sheet to move the sheet. Therefore, it is possible to mitigate a shock when the cams contact the sheet, so that the sheet and the printed surface is not damaged. Additionally, a torque restricting device is connected to the rotary shaft of the cams, and therefore even when more than a prescribed number of sheets are stacked in the tray, the cams and the sheet batch interfere with which other, and the rotary shaft idly rotates, thereby preventing the apparatus from being damaged. Furthermore, by combining the cams and the sheet temporary standby mechanism, time required for the stapling process can be secured, so as to be even more adapted to high-speed printing.

According to an embodiment of the present invention, a sheet post process device with a stapler mechanism suitable for high-speed printing can be provided.

According to an aspect of the present invention, there is provided a sheet post process device with a stapler mechanism, the sheet post process device including a conveying path configured to convey a sheet on which an image is formed to the stapler mechanism; a first sensor disposed along the conveying path and configured to detect a moving position of the sheet; a tray in which plural of the sheets are stacked to undergo a stapling process; and a cam disposed at a conveying path outlet through which the sheet is ejected from the conveying path to the tray, the cam having a spiral shape and being rotatable, wherein when the sheet passes through the conveying path outlet, the cam rotates and comes into contact with the sheet to move the sheet to the tray.

Additionally, the sheet post process device with the stapler mechanism further includes a second sensor disposed on a rotary shaft of the cam and configured to detect a phase of the cam, wherein the cam has an Archimedean spiral shape; and the cam is controlled to move and stop based on information from the first sensor and information from the second sensor.

Additionally, the sheet post process device with the stapler mechanism further includes a torque restricting device connected to the rotary shaft of the cam, wherein in the event that more than a prescribed number of the sheets are stacked in the tray, the cam interferes with a stacked batch of the sheets, and the rotary shaft idly rotates.

Additionally, the sheet post process device with the stapler mechanism further includes a temporary standby conveying path in which plural of the sheets can be temporarily held, the temporary standby conveying path being provided on the conveying path; a gate disposed upstream of the temporary standby conveying path and configured to guide the sheet for aligning plural of the sheets in the temporary standby conveying path; and a stopper disposed downstream of the temporary standby conveying path and configured to open and close so as to stop and hold the sheet.

The present invention is not limited to the specifically disclosed embodiment, and variations and modifications may be made without departing from the scope of the present invention.

The present application is based on Japanese Priority Patent Application No. 2008-008577, filed on Jan. 18, 2008, the entire contents of which are hereby incorporated herein by reference.

What is claimed is:

1. A sheet post process device with a stapler mechanism, the sheet post process device comprising:

a conveying path configured to convey a sheet on which an image is formed to the stapler mechanism;

a first sensor disposed along the conveying path and configured to detect a moving position of the sheet;

a tray in which plural of the sheets are stacked to undergo a stapling process; and a cam disposed at a conveying path outlet through which the sheet is ejected from the conveying path to the tray, the cam having a spiral shape and being rotatable, wherein when the sheet has passed through the conveying path outlet and is freely falling, the cam rotates and comes into contact with the sheet to forcibly push the sheet down to the tray, so that so that the sheet is stacked in the tray within a prescribed length of time;

a second sensor disposed on a rotary shaft of the cam and configured to detect a phase of the cam, wherein the cam has an Archimedean spiral shape, and the cam is controlled to move and stop based on information from the first sensor and information from the second sensor; and a torque restricting device connected to the rotary shaft of the cam, wherein in the event that more than a prescribed number of the sheets are stacked in the tray, the cam interferes with a stacked batch of the sheets, and the rotary shaft idly rotates.

2. The sheet post process device with the stapler mechanism according to claim 1, further comprising:

a temporary standby conveying path in which plural of the sheets can be temporarily held, the temporary standby conveying path being provided on the conveying path;

a gate disposed upstream of the temporary standby conveying path and configured to guide the sheet for aligning plural of the sheets in the temporary standby conveying path; and a stopper disposed downstream of the temporary standby conveying path and configured to open and close so as to stop and hold the sheet.

3. The sheet post process device with the stapler mechanism according to claim 1, wherein a surface of said cam includes a linear portion, and wherein the cam begins to rotate after a leading edge of the sheet has passed the linear portion of the surface of the cam.

4. A sheet post process device with a stapler mechanism, the sheet post process device comprising:

a tray in which plural of sheets are to be stacked to undergo a stapling process;

a conveying path configured to convey a sheet on which an image is formed to a conveying path outlet, wherein the conveying path outlet is positioned such that a sheet from the conveying path outlet will freely fall to be stacked in the tray;

a first sensor disposed along the conveying path and configured to detect a moving position of the sheet; and cam means for forcibly pushing a freely falling sheet from the conveying path outlet, which sheet has not yet reached the tray, down to the tray, so that so that the sheet is stacked in the tray within a prescribed length of time.

5. The sheet post process device with the stapler mechanism according to claim 4, further comprising:

a second sensor disposed on a rotary shaft of the cam and configured to detect a phase of the cam, wherein:

the cam has an Archimedean spiral shape; and the cam is controlled to move and stop based on information from the first sensor and information from the second sensor.

6. The sheet post process device with the stapler mechanism according to claim 5, further comprising:

a torque restricting device connected to the rotary shaft of the cam, wherein:

in the event that more than a prescribed number of the sheets are stacked in the tray, the cam interferes with a stacked batch of the sheets, and the rotary shaft idly rotates.

7. The sheet post process device with the stapler mechanism according to claim 4, further comprising:

a temporary standby conveying path in which plural of the sheets can be temporarily held, the temporary standby conveying path being provided on the conveying path;

a gate disposed upstream of the temporary standby conveying path and configured to guide the sheet for aligning plural of the sheets in the temporary standby conveying path; and a stopper disposed downstream of the temporary standby conveying path and configured to open and close so as to stop and hold the sheet.

8. The sheet post process device with the stapler mechanism according to claim 4, wherein a surface of said cam includes a linear portion, and wherein the cam begins to rotate after a leading edge of the sheet has passed the linear portion of the surface of the cam.

* * * * *